US008210765B2

(12) United States Patent
Larsen

(10) Patent No.: US 8,210,765 B2
(45) Date of Patent: Jul. 3, 2012

(54) WASHING BRUSH

(75) Inventor: Søren J. Larsen, Roskilde (DK)

(73) Assignee: Danbrush Aps., Roskilde (DK)

( * ) Notice: Subject to any disclaimer, the term of this patent is extended or adjusted under 35 U.S.C. 154(b) by 1007 days.

(21) Appl. No.: 11/912,787

(22) PCT Filed: Apr. 24, 2006

(86) PCT No.: PCT/IB2006/051258

§ 371 (c)(1),
(2), (4) Date: May 1, 2008

(87) PCT Pub. No.: WO2006/114752

PCT Pub. Date: Nov. 2, 2006

(65) Prior Publication Data

US 2009/0049631 A1 Feb. 26, 2009

(30) Foreign Application Priority Data

Apr. 26, 2005 (DK) ..... 2005 00611

(51) Int. Cl.
*A47L 11/04* (2006.01)

(52) U.S. Cl. ..... 401/282; 401/270; 401/276

(58) Field of Classification Search ..... 401/270, 401/274, 276, 282, 284, 286, 287, 288
See application file for complete search history.

(56) References Cited

U.S. PATENT DOCUMENTS

| | | | | |
|---|---|---|---|---|
| 1,091,888 | A * | 3/1914 | Lorzing | 401/288 |
| 4,429,434 | A | 2/1984 | Sung-shan | |
| 4,932,349 | A * | 6/1990 | Gohon | 114/222 |
| 5,211,494 | A | 5/1993 | Baijnath | |
| 2004/0086322 | A1 | 5/2004 | DeLaine, Jr. | |
| 2005/0025561 | A1 | 2/2005 | Larsen | |

* cited by examiner

*Primary Examiner* — David Walczak
(74) *Attorney, Agent, or Firm* — Osha • Liang LLP

(57) ABSTRACT

A brush having a body with scrubbing means (6), a compartment for washing liquid and a channelling means (18) is provided. The brush has first (12) and second apertures for fluid communication between surfaces of the brush and the compartment The brush is particularly suitable for cleaning of non-horizontal surfaces.

18 Claims, 6 Drawing Sheets

WASHING BRUSH

CROSS-REFERENCE TO RELATED APPLICATION

This application is a national phase filing, under 35 U.S.C. §371(c), of International Application No. PCT/IB2006/051258, filed Apr. 24, 2006, the disclosure of which is incorporated herein by reference in its entirety.

FEDERALLY SPONSORED RESEARCH OR DEVELOPMENT

Not Applicable

BACKGROUND OF THE INVENTION

1. Technical Field of the Invention

The invention relates to a washing brush with a compartment for containing washing liquid. Particularly, the invention relates to such a washing brush for washing of non-horizontal surfaces.

2. Background of the Invention

When an object is cleaned with a conventional brush and a water-based liquid, the brush must typically be dipped into the water container very often to dispense sufficient water to allow for adequate cleaning. This has previously been solved by the use of a water dispensing brush with a hose connected thereto. However, much water is thereby wasted and the operator is likely to become soiled.

These problems were dealt with in WO 03/049571, which discloses a brush for washing an object. The brush comprises a compartment and an aperture for allowing water to flow into the compartment, which aperture may be provided with a throttling means, and an aperture for allowing water to flow out of the compartment.

However, all these brushes are mainly suitable for use on horizontal and downwardly facing surfaces, as water tends to flow down the handle and soil the operator when the brush is used for cleaning, for example on vertical surfaces.

OBJECTS OF THE INVENTION

It is an object of the invention to provide a brush of the type indicated where the tendency for washing liquid to flow down the handle is reduced considerably or completely removed when the brush is used for cleaning of non-horizontal surfaces, such as vertical surfaces.

DISCLOSURE OF THE INVENTION

The above and other objects of the invention are realized by the brush according to this disclosure, According to the invention, a brush comprises a body with scrubbing means attached to a first surface portion of said brush. The scrubbing means preferably comprise brush bristles or hairs of a non-scratching material as this provides a suitable scrubbing means and also may form part of the channelling means (see below). However, sponge-like or foam structures of natural or synthetic material may also be feasible. The scrubbing means forms a scrubbing surface away from the first surface portion, typically 0.5 cm to 10 cm from the first surface portion. The scrubbing surface is preferably substantially flat, but scrubbing surfaces with rounded edges or three-dimensional scrubbing surfaces, such as cylindrical or spherical-like scrubbing surfaces are within the scope of the invention.

The body further has a compartment for containing a washing liquid. It is preferred that the washing liquid is water or a water-based solution or suspension with cleaning aids, such as a soap or a surfactant, as such washing liquid typically does not require special protection equipment and may be easily disposed.

In a preferred embodiment, the walls forming the compartment of the brush comprise:

- A bottom wall portion substantially parallel to the first surface portion. When the brush is arranged for washing of a vertical surface, this wall portion is mainly arranged vertically.
- A lower side wall portion. When the brush is arranged for washing of vertical surfaces, the lower side wall portion forms a generally horizontal floor of the compartment. The lower side wall portion is advantageously arranged at an angle to the bottom wall portion so that the floor extends away from the bottom wall portion in a direction above horizontal, such as 2-30° above horizontal.
- End wall portions for preventing washing liquid from exiting the compartment via the ends of the compartment.

In a preferred embodiment, the above walls are substantially flat. However, a more holistic approach is within the scope of the invention. For example, the lower side wall portion may comprise or consist of a spherical or cylindrical part forming the lower side and the (non-compulsory and hence not listed) top wall portion and/or end wall portions.

The body further comprises a second aperture or passage for fluid communication between a surface of said body and the compartment for introducing washing liquid into the compartment. The second aperture may advantageously be open to the first surface portion of the body as this allows washing liquid to enter the compartment while the scrubbing means are being at least partially submersed into the washing liquid, whereby the scrubbing means may be cleaned. The second aperture may be arranged in another part of the compartment, such as in a wall part, e.g. the ceiling, whereby the scrubbing means may cover a larger fraction of the first surface portion as no space is taken by the second aperture.

The second aperture may advantageously be provided with a washing liquid flow throttling means for throttling or preventing return flow of washing liquid from the compartment through the second aperture. The provision of a flow throttling means ensures that most of the washing liquid departs from the compartment via the first aperture (see below) and not via the second aperture. Hence, a short compartment filling time may be combined with a long compartment emptying time by having a relatively large second aperture and a relatively small first aperture. The flow throttling means may advantageously comprise a non-return valve means as this promotes a longer compartment emptying time. In a preferred embodiment, a plurality of second apertures are provided whereby the compartment filling time may be reduced even more. Preferably two, three, four or more second apertures are provided.

In a preferred embodiment, the throttling means comprises a plate of elastic material such as plastic or rubber. The plate has a size larger than the interior mouth of the second aperture and having a portion thereof arranged at least partially on the inner wall surface of said compartment adjacent said mouth such that said plate in relaxed condition, i.e. when the plate is not subjected to a force e.g. by washing liquid, substantially covers the mouth.

The plate may advantageously be biased towards the second aperture as this tends to improve the closing of the second aperture. The bias may advantageously at least partially be based on the plate being forced towards the part of the inner wall surface of the compartment, e.g. by a protruding part of a top part of the body. The bias may be enhanced by having a protrusion in an area covered by the plate, which protrusion—in relation to the area where the plate is being forced towards the inner wall surface—is arranged opposite of the second aperture so that the plate is bent away from the inner wall surface in the opposite direction of the second aperture. This allows for a very simple manufacture of plates. Alternatively, the plate may be manufactured in a non-flat shape so that the plate is forced towards the second aperture when the plate is being forced towards the inner wall surface. This allows for a more simple shape of the body.

If more than one compartment is present, it is highly advantageous to have at least one second aperture connected to each compartment as this allows for water to be dispensed from each compartment and hence achieve a more even water distribution. Each compartment may be equipped with more than one second aperture, but it is preferred to have only one second aperture for each compartment.

The body also comprises a first aperture or passage for fluid communication between the first surface portion of the brush and the compartment. When the brush is used for washing of non-horizontal surfaces, such as vertical surfaces, it has been found that it is highly advantageous that at least one of the first apertures is arranged in the bottom wall portion near the lower side wall portion so that the amount of water trapped below the first aperture and hence not being able to leave the compartment is greatly reduced. In other words, this arrangement of the first aperture leads to an efficient utilization of the complete volume of the compartment as all water can leave through the first aperture—In a preferred embodiment, a plurality of first apertures are provided whereby the water may be more evenly distributed at the first surface portion of the brush. Preferably two, three, four, five, six, seven, eight or more first apertures are provided for each compartment.

The compartment may advantageously be equipped with more than one first aperture in fluid communication between the first surface portion of the brush and the compartment. Typically, each compartment has one to six or even more first apertures dependent on the size of the compartment and the size of the apertures. By distributing the apertures in different areas of the compartment, this allows for a more even distribution of water to the first surface portion of the brush, which has proven to provide a more uniform and superior cleaning action. This is particularly important when the compartment extends along a substantial horizontal length of the brush when the brush is arranged for washing of vertical surfaces. Then two of the first apertures may advantageously be arranged away from each other near the end wall portions of the compartment.

If more than one compartment for containing washing liquid is arranged in the body, then each compartment is typically connected to one or more of the first apertures.

The brush is equipped with a channelling means extending from near the first aperture at the first surface portion of the brush towards the scrubbing surface. The channelling means is provided to direct washing liquid arriving at the first surface portion from the compartment via the first aperture so that the washing liquid is mainly directed away from the first surface portion of said brush towards a scrubbing surface formed by the scrubbing means away from the first surface portion. As the washing liquid is directed away from the first surface by the channelling means, the washing liquid will not run down the brush and soil the operator.

In a preferred embodiment the channeling means includes a channel-like structure arranged at least below the first aperture when the brush is arranged for washing of vertical surfaces. This facilitates catching of the washing liquid from the first aperture and therefore improves the efficiency of the channeling means. The channel-like structure may be arranged only below the first aperture, but it has been found that a channel-like structure encircling at least 180° of the first aperture is more efficient as it will tend to also catch the water when the brush is tilted slightly during operation. In a more preferred embodiment, the channel-like structure encircles at least 270° of the first aperture, which allows for a wider range of operation angle of the brush.

The most advantageous channel-like structure encircles the first aperture substantially completely. This allows the brush to be operated with horizontal movement when the brush is tilted 90° without risking that water starts to flow down the brush towards the operator. Furthermore, a channel-like structure, which encircles the first aperture completely, may tend to form a chamber in the channel-like structure, which may be substantially closed when the brush is not in use and hence reduce, delay or prevent water from flowing from the compartment until the brush is operated.

In a preferred embodiment, the channelling means comprises a part of the scrubbing means near the first aperture. Thereby the use of a separate channelling means may be avoided. In one such embodiment, the channelling means comprises a number of brush bristles arranged adjacent to the first aperture in at least one tight layer. By tight layer is meant that the layer is substantially water impermeable parallel to the first surface portion of the brush. As some washing liquid may escape through such a layer, a more preferred embodiment comprises at least two tight layers and most preferably at least three tight layers of brush bristles arranged adjacent to the first aperture.

In one embodiment of the invention, the brush is provided with brush bristles arranged close to each other on a major part of the first surface portion of the brush so that the brush bristles does not form a number of tight layers but rather an overall structure being substantially water impermeable parallel to the first surface portion. This design is advantageous in that the first apertures or additional first apertures may be provided, e.g. by drilling, after the body has been assembled.

In another preferred embodiment, the channelling means comprises an elastic member, which is not water permeable or at least only slowly water permeable. It has been found that in many cases, the elastic member typically need not extend all the way to the scrubbing surface formed by the scrubbing means as the washing liquid tends to be carried along the scrubbing means to the scrubbing surface when the washing liquid has been directed away from the first surface portion of the brush. However, in one embodiment, the elastic member extends all the way to the scrubbing surface. The elastic member is preferably a sheet-like member, which may be arranged below, partially encircling or completely encircling the first aperture, or the elastic member is an elastic bulk member having a through-going channel or a surface channel.

In a particularly preferred embodiment, the channelling means extends away from the body in a direction below horizontal when the brush is arranged for washing of vertical surfaces. This prevents the washing liquid to slip back to the first surface portion of the brush along the outer surface of the channelling means.

In some cases, it is advantageous to arrange the first aperture away from the lower edge of the first surface portion of the brush when the brush is arranged for washing of vertical surfaces. This is particularly the case when the channelling means comprises one or more tight layers of brush bristles or another channelling means, which requires a substantial size below the first aperture. Hence, it is preferred that the distance between the first aperture and the lower edge is sufficient to allow for arrangement of the channelling means at least partially below the first aperture when the brush is arranged for washing of vertical surfaces.

As previously discussed, it is also preferred that the first aperture is arranged near the bottom wall portion of the compartment and hence, it is preferred that the compartment is arranged higher than the lower edge of the first surface portion of the brush when the brush is arranged for washing of vertical surfaces since this allows for complete emptying of the compartment.

In a preferred embodiment, the body further comprises a third aperture or passage to allow air to exit the compartment when washing liquid flows into the compartment through the first aperture. This allows the washing liquid to enter the compartment faster. It is advantageous that the third aperture or passage is open to a second surface portion of said brush away from the first surface portion of said brush as this reduces the likelihood of air getting trapped inside the compartment. Moreover, the third aperture may advantageously be arranged near a vertical centre plane when the brush is arranged for washing of vertical surfaces as this also reduces the risk of air becoming trapped during filling of the compartment with washing liquid. In a preferred embodiment, a plurality of third apertures are provided whereby the likelihood of air getting trapped inside the compartment is reduced further. Preferably one, two, three or more third compartments are provided.

In one embodiment, the opening of the third aperture is adjustable by an aperture-sizing means. This allows for adjusting of air-flow speed through the third aperture. Preferred examples of aperture-sizing means is a pivoting or a sliding member.

In a particularly advantageous embodiment, the third passage comprises a water seal structure. This reduces or postpones water flow out of the third aperture and first aperture if the brush is left with water in the compartment. The water seal structure preferably comprises a first blind tube connected to the body towards the first surface portion and a second open tube connected to the body away from the first surface portion where the first and the second tube are arranged so that the second tube fits into the first tube and a zigzag opening is formed between the inner of the compartment and the second surface portion via the first and the second tubes Preferably the tubes are arranged substantially parallel to the lower side wall portion. This arrangement allows for manufacturing by injection molding in a rigid mold, which is a preferred manufacturing method.

For some types of cleaning action it is advantageous to disperse an additive during the cleaning to increase the cleaning effectiveness. Therefore, a preferred embodiment further comprises a dispensing means for continuously or intermittently dispensing an additive material. Examples of suitable additives are cleansing liquid, cleansing paste or cleansing powder, e.g. soap, detergent, another surfactant or the like. The additive is preferably dispensed into the compartment for containing washing liquid or via an additive conduit to the first surface of said body. If an additive conduit is provided, it is highly advantageous to also provide a second channelling means arranged near an additive conduit opening at the first surface of said body. Such a second channelling means may for example be of the same type and shape as the channelling means for washing liquid.

The brush may advantageously comprise a handle member for increasing the operation area, which may be reached by the operator, particularly with regard to the reachable height. The handle member is preferably a telescopic type handle member, which is at least temporarily connectable to the body of the brush. A telescopic type handle member allows for adjusting the length of the handle member without having to replace the handle member.

In a preferred embodiment, the handle member is connected to the brush near the vertical center plane of the brush when the brush is arranged for washing of vertical surfaces, and more preferably the handle member is connected at the vertical center plane of the brush. This allows for a stable and balanced grip of the brush even when a long handle member is utilised.

In one embodiment, the handle member is connected to the brush via a stiff connection. This allows for a simple and affordable design. However, it may be advantageous to apply a rocking mechanism or a tilt-table connection as this provides a more flexible operation practice where the angle between the handle member and the scrubbing surface of the brush may vary continuously during use.

The brush may be manufactured in numerous ways, but it is highly advantageous to manufacture the main parts of the brush, e.g. a base part and a top part, by injection molding of plastic. This allows for a fast and reliable manufacturing process. The base part and the top part should be connected in a air-tight manner such as by the use of a sealing material like e.g. a silicone-based adhesive.

Another aspect of the invention concerns the use of a channelling means for directing water away from a first surface portion of the brush in a brush according to the first aspect of the invention or in the brushes mentioned in the background section. This use is particularly advantageous since it reduces the likelihood of the operator to become soiled by the washing liquid when using such brushes for cleaning of substantially vertical surfaces.

In another aspect of the invention, the object is to provide a more even distribution of water when a brush as discussed in the background section is used for washing of a non-horizontal surface, such as a vertical surface. A preferred solution to this problem is to provide one or more sub-compartments at the bottom wall portion of the compartment, such as one, two, three, four, five, six, seven, eight or more sub-compartments. A sub-compartment is a washing liquid retaining structure, which is arranged above the lower side wall portion of the compartment. The sub-compartment has a first aperture through which washing liquid retained in the sub-compartment may be dispensed to the first surface portion of the brush. Typically, the volume of washing liquid retained in the sub-compartment is only a small fraction of the washing liquid overall retained in all compartment and hence the first aperture of the sub-compartment will tend to run dry before the first aperture arranged near the lower side wall portion of the compartment. However, during, operation, the brush will typically be shaken vigorously, which will lead to the sub-compartments being refilled from time to time with washing liquid from the compartment until the compartment is completely empty. Therefore, water is dispensed at a level above the first aperture of the compartment even if the average water level of the compartment is substantially below the first aperture of the sub-compartment and a more even water distribution is realised leading to an improved and more efficient cleaning action of the brush.

The sub-compartment comprises a lower side sub-wall portion forming a floor extending above horizontal from the bottom wall portion and end sub-wall portions.

The sub-compartment is open to the compartment and has at least one first aperture near the lower side sub-wall portion. In a preferred embodiment, the above sub-walls are substantially flat. However, a more holistic approach is within the scope of the invention. For example, the lower side sub-wall portion may comprise or consist of a spherical or cylindrical part forming the lower side and/or end sub-wall portions.

In a particularly advantageous embodiment, the brush comprises a plurality of sub-compartments leading to a very even dispersion of water.

Another preferred solution to uneven dispersion of water from the compartment is to provide at least one further compartment for containing washing liquid. The further compartment is a washing liquid retaining structure. Each compartment typically has corresponding first aperture(s) and second aperture(s). As washing liquid will tend to collect near the lower side wall of each compartment, a plurality of compartments preferably with corresponding first apertures arranged near the lower side wall of the compartments will allow for more areas with water dispersion when the brush is almost empty of washing liquid. A particularly advantageous arrangement of compartments is where the compartments are arranged one at least partially above another when the brush is oriented as during scrubbing operation. In this case, the washing liquid dispersion will be distributed vertically over the first surface portion of the brush even when the brush is almost empty of washing liquid leading to a more even distribution of washing liquid and hence improved washing action.

In an area where two compartments are arranged one above another, it is highly advantageous that the wall separating the compartments extends away from the bottom wall portion in a direction above horizontal, as this allows for complete emptying of the above compartment.

An embodiment of the brush having both channelling means and water retention structure, such as one or more further compartments and/or sub-compartments is particularly advantageous, as the channelling means enhance the controlled distribution and hence the efficient use of water from the compartments. Furthermore, water retention structures will raise the average exit position of the washing liquid and hence soften the requirements of the channelling structure, due to the increased average amount of scrubbing means below the washing liquid at release, which increased amount of scrubbing means may facilitate the transport of the washing liquid if the washing liquid is lost from the channelling means.

The brush according to the invention may be used for washing of horizontal surfaces, but it is particularly advantageous for washing of non-horizontal surfaces and in particular substantially vertical surfaces where the scrubbing surface of the brush is above the hands of the operator during use. This is due to the very efficient system for prevention of soiling of the operator in such applications and/or the more even distribution of washing liquid. Examples of applications where the brush according to the invention is advantageous are washing of vehicles, such as trains, cars, buses, trucks and recreation vehicles; washing of signs, such as street signs, road signs or advertisement boards; cleaning of fixed structures, such as buildings, walls, bus stops; and washing of boats and containers. However, the skilled person would immediately realise that the brush may be used for similar cleaning purposes without departing from the inventive concept of the invention.

BRIEF DESCRIPTION OF THE DRAWINGS

The invention will be explained more fully below with reference to exemplary embodiments as well as the drawings, in which.

All the figures are highly schematic and not necessarily to scale, and they show only parts which are necessary in order to elucidate the invention, other parts being omitted or merely suggested.

DETAILED DESCRIPTION OF THE PREFERRED EMBODIMENTS

Figure 1:
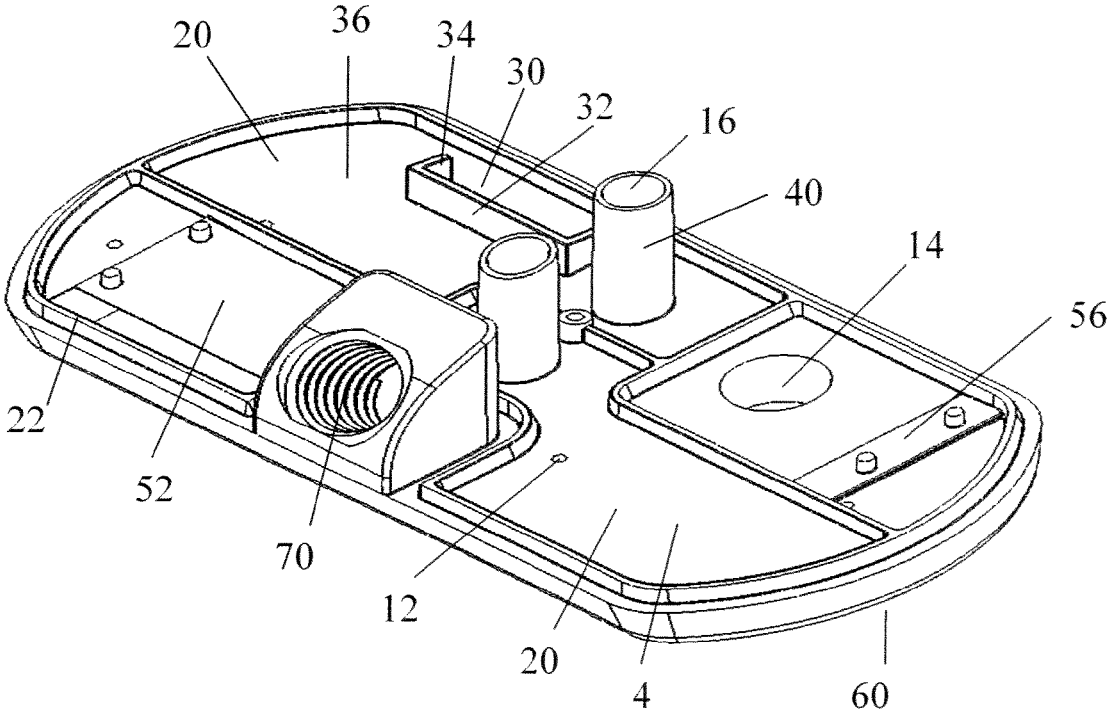
FIG. 1 shows a preferred embodiment of a bottom part of the brush.
Figure 2:
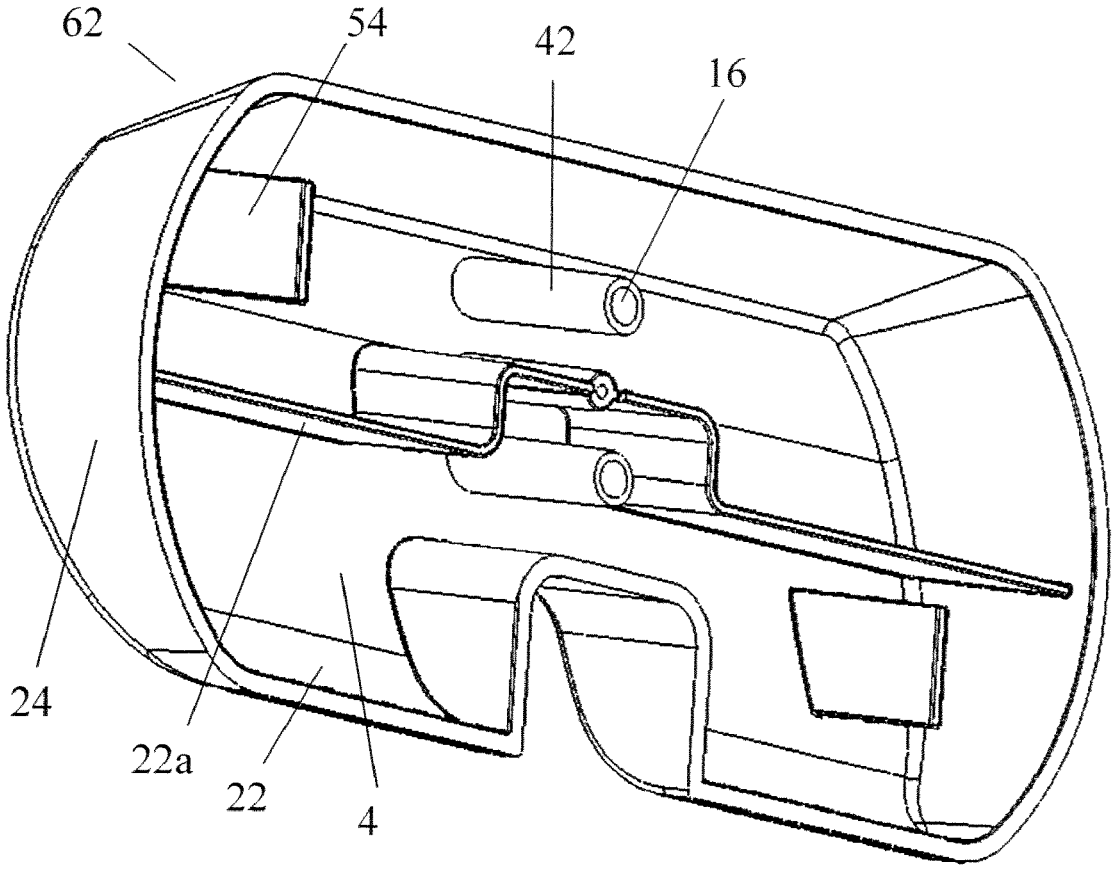
FIG. 2 shows a preferred embodiment of a top part of the brush.

As discussed previously, it is preferred to manufacture the brush body in two main parts, namely the base part 60 shown in FIG. 1 and the top part 62 (see FIG. 2). The body of FIG. 1 comprises a compartment 4 in communication with the first surface portion via first apertures 12 for allowing washing liquid to flow out of the compartment and second apertures 14 (one covered by the plate 52) for introducing washing liquid into the compartment. The second apertures are provided with flow throttling means of the plate 52 of elastic material type. The plate 52 is shown covering one of the second apertures whereas the other plate is omitted for sake of clarity. The plate is held in position by two protrusions corresponding to two holes in the plate; however, the person skilled in the art would, based on this, recognize various other ways of holding the plate within the scope of the invention. The area 56 where the protrusions are arranged is furthermore slightly inclined away from the second aperture. This—together with the corresponding biasing means of the top part of the body—provides for a biasing of the plate towards the second aperture. The plate or the area near the second aperture may also (not shown) be provided with a sealing member to further increase the sealing effect of the plate.

The body is further provided with a sub-compartment 30 having a lower side sub-wall portion 32 and end sub-wall portions 34 in the further compartment 36. The sub-compartment is provided on the bottom wall portion 20 of the further compartment. Furthermore, the first blind tube 40 forming part of a water seal structure that provides the third aperture 16 is shown. Finally, the connection to the handle member is indicated by 70.

FIG. 2 shows the top part 62 corresponding to the base part of FIG. 1. Here, the compartment 4 and the further compartment 36 are more clearly identified. The lower side wall portions 22 and 22*a* of the compartment 4 and further compartment 36, respectively, are also seen as well as the end wall portions 24. The biasing means 54 are arranged positioning-wise and lengthwise so that they force the plate 52 of FIG. 1 onto the bottom wall portion of the compartment by pressing between the inclined area 56 and the second aperture 14. The open tubes 42 forming part of the water seal structure that provides the third aperture 16 are also shown. The cooperation between the open tube 42 and the blind tube 40 are more clearly seen in FIG. 4. The wall portions of the top part fit tightly to the wall portions—or rather guiding portions—of the base part and may be secured thereto by adhesive, such as silicone adhesive, after positioning of the plates inside the compartments.

Figure 3:
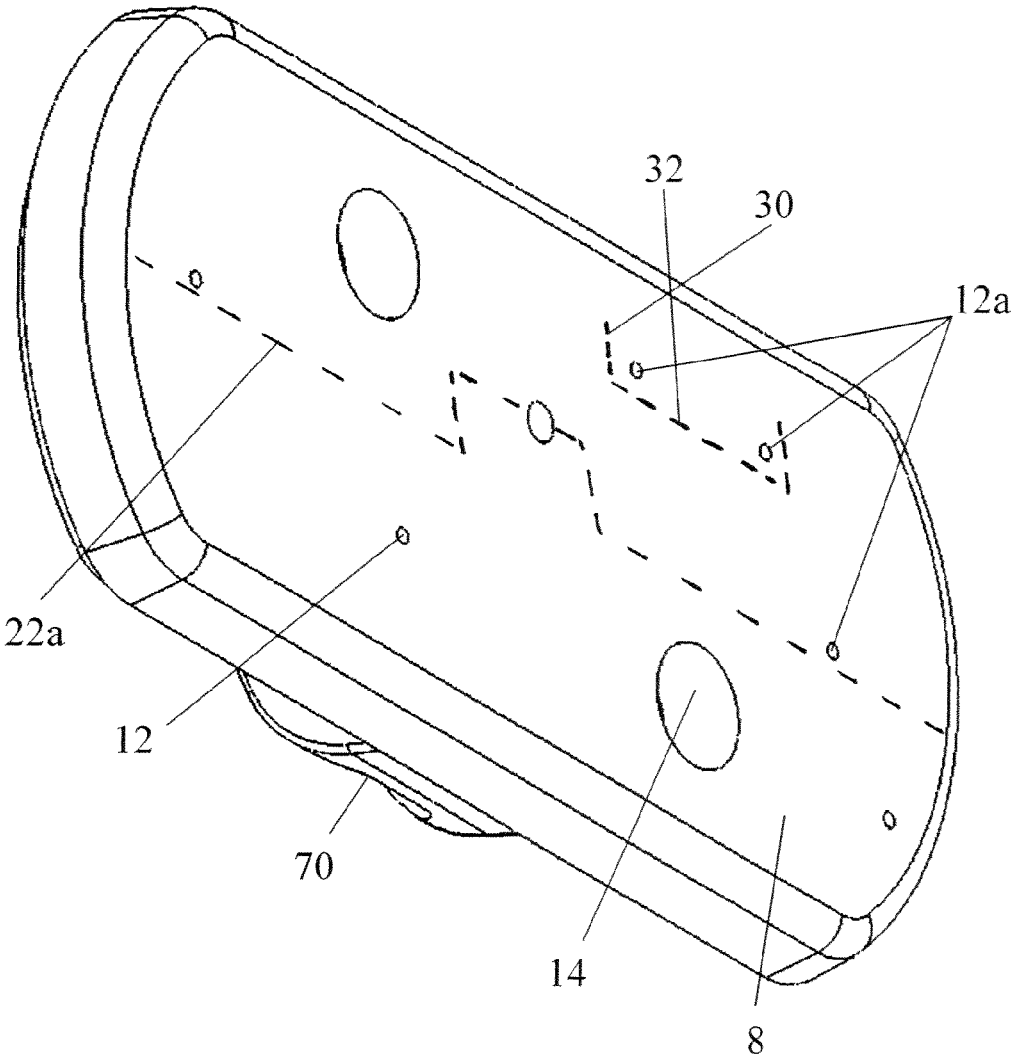
FIG. 3 shows a bottom view of the bottom part of FIG. 1.

FIG. 3 is a bottom view of the base part. Scrubbing means has been omitted to improve clarity. Therefore, the first surface portion 8 of the brush is visible. Furthermore, the second apertures 14 corresponding to the compartment and the further compartment as well as the first apertures 12, 12*a* are seen. The dashed lines indicate the position of the lower side wall portion of 22*a* of the further compartment and the sub-compartment 30. It is observed that the first apertures 12*a* positioned away from the edge of the first surface portion 8 corresponding to the lower edge when the brush is arranged for washing are positioned close to the corresponding lower side wall portions 30 and 22*a*. On the contrary, the first apertures 12 nearest the lower edge of the first surface portion 8 of the brush when the brush is arranged for washing of vertical surfaces are moved slightly away from the edge to allow for positioning of channelling means on the first surface portion (not shown for sake of clarity).

As shown in FIG. 3, the brush is preferably considerably wider than high when arranged for washing of a vertical surface. Preferably the first surface portion is least 1½ times as wide as it is high, more preferably at least twice as wide as it is high and most preferably the first surface portion is at least 2½ times as wide as it is high. This allows for a relatively large washing area, particularly when the brush is provided with a centrally arranged handling member and mainly operated. In vertical movements above the height of the operator.

Figure 4:
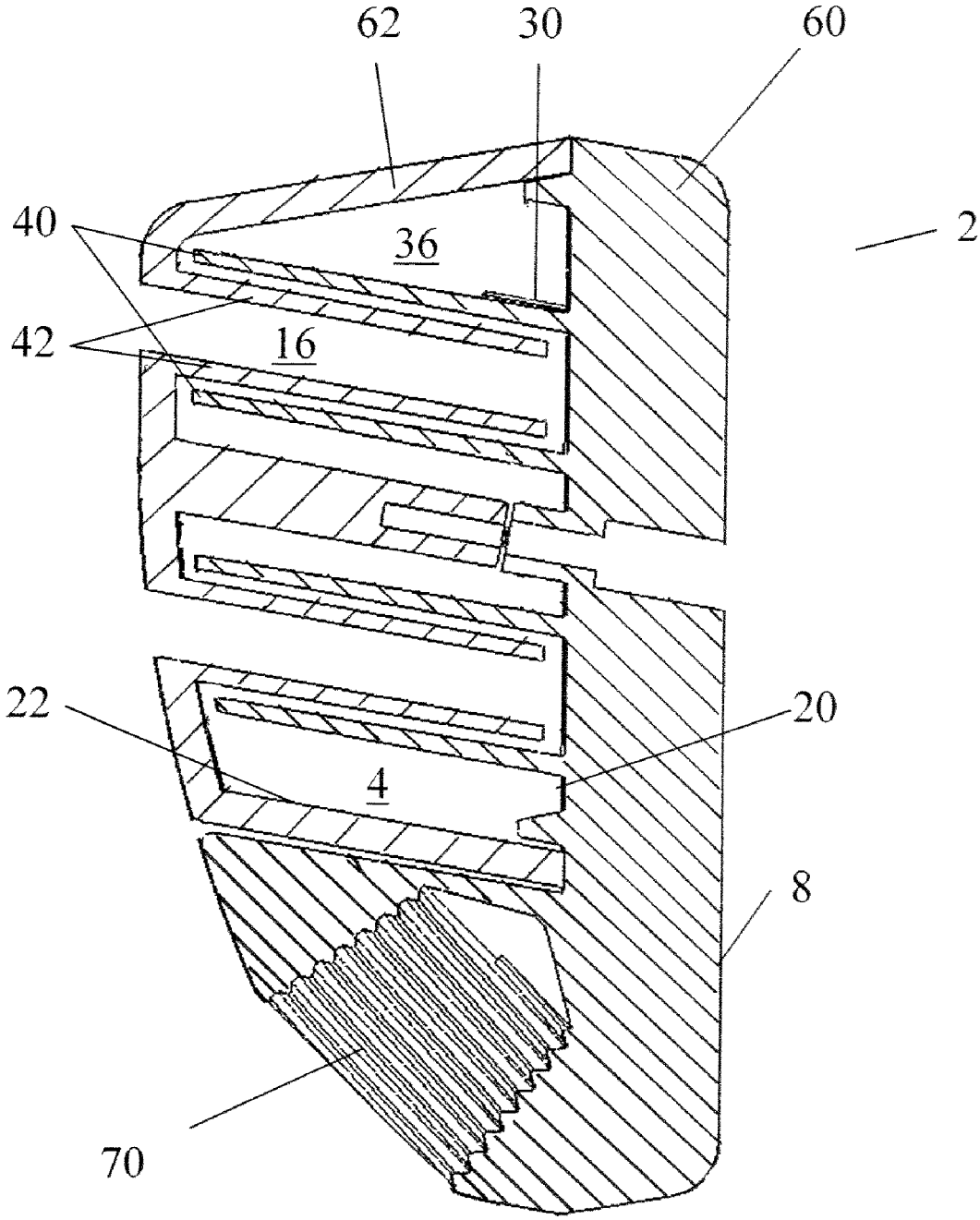
FIG. 4 shows a cross section near a vertical center plane of a preferred embodiment.

In FIG. 4, the conditions concerning the formation of the water seal structure of the body, which structure provides the third aperture in this preferred embodiment, are indicated. Starting from the compartment 4 and the further compartment 36 for air to escape, the air has to enter into the first blind tube 40 away from the bottom wall portion of the compartment. Then the air must travel in the narrow path between the first blind tube 40 and the second open tube 42 before it may inter into the open tube 42, from where the air may escape to the surroundings. Such an arrangement serves to postpone or delay leak of water from the compartment until the brush is moved during use. Hence, if the brush is left filled with water in the compartment, only a small amount of water will leak out—particularly if the brush is positioned with the scrubbing means facing upwards.

It is preferred that the compartment is open to the exterior of the compartment, i.e. the ambient air, only via the apertures corresponding to the compartment. Hence only first aperture or apertures, second aperture or apertures and the optional third aperture or apertures provide connection between the interior of the compartment and the ambient air outside the compartment. This provides for a more controlled release of the washing liquid as air, which must enter the compartment for the water to be released may only enter via paths of limited (and controlled if aperture-sizing means are provided) size.

Figure 5A:
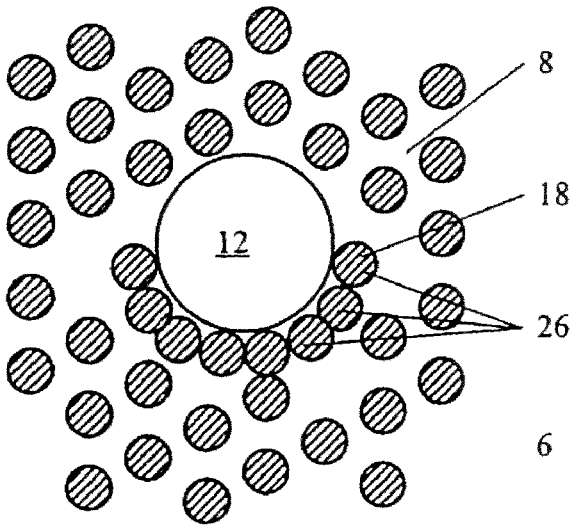
FIGS. 5A-C show various embodiments of the channelling means.
Figure 5B:
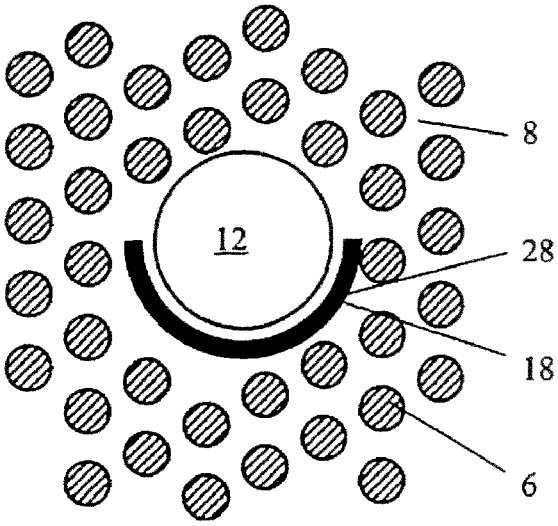
Figure 5C:
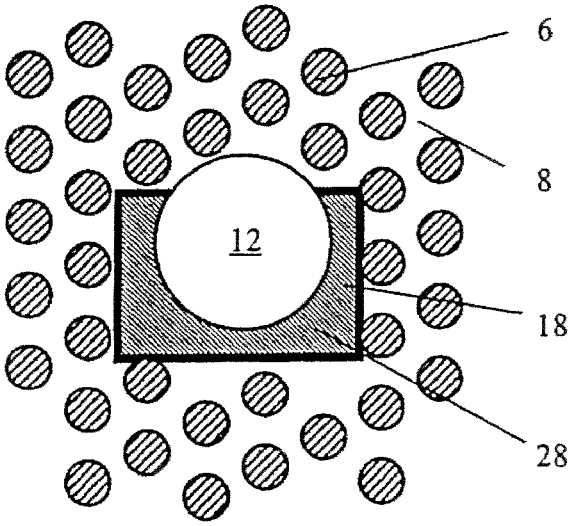

FIGS. 5A-C are sketches of a section just outside the first surface portion 8 of the brush, i.e. through the scrubbing means. It should be observed that other types of scrubbing means than brush bristles are feasible as discussed elsewhere, but for sake of clarity, only this type of scrubbing means are shown in FIGS. 5A-C. In FIG. 5A, the channelling means 18 is formed by brush bristles 6 arranged in a tight layer 26 near the first aperture 12. In FIG. 5B, the channelling means 18 is formed by an elastic member 28. The elastic member is shaped to more or less conform to the shape of the first aperture 12. In FIG. 5C, the channelling means consists of an elastic bulk member 28 with a surface channel resembling a part of the first aperture arranged therein.

The channelling means may extend all the way to the scrubbing surface, however, when the channelling means comprises other members than the scrubbing means, such members typically do not extend that far. In cross sections of a brush arranged for washing are shown. The scrubbing means 6 form a scrubbing surface 10 away from the first surface portion 8 of the brush. In FIG. 16A, the channelling means 18 consists of an elastic member 28 arranged below the first aperture 12. The elastic member is arranged so that it extends away from the first surface portion below horizontal. This reduces the likelihood for washing liquid being conducted by the elastic member to be directed along the lower surface of the channelling means back towards the first surface portion of the brush.

Figure 6A:
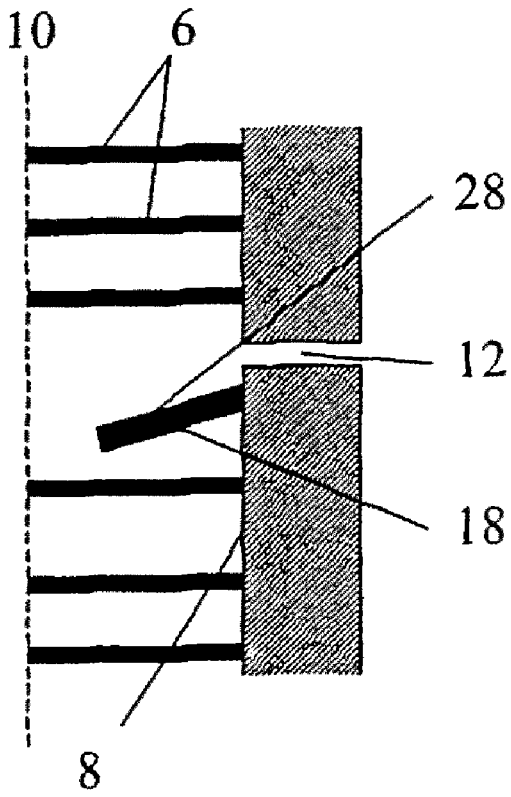
FIGS. 6A-B show various embodiments of the channeling means.
Figure 6B:
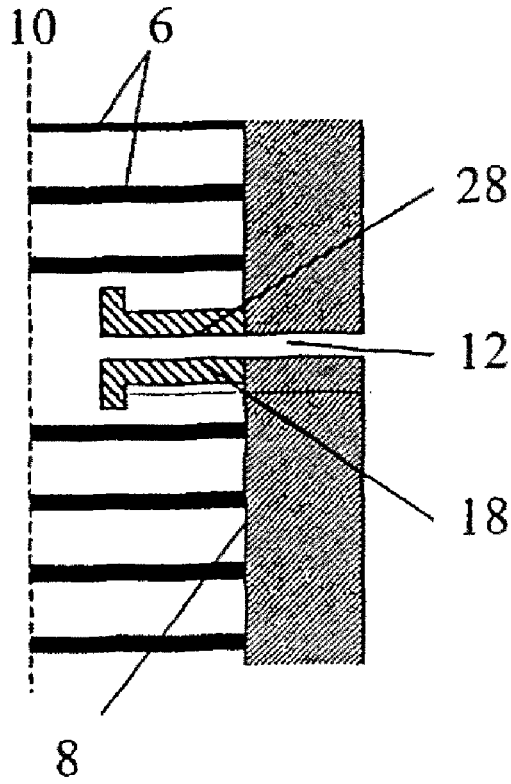

In FIG. 6B, the channelling means 18 is a cylindrical elastic member 28. As the cylindrical member is arranged horizontally, washing liquid may run back towards the first surface portion on the outside of the channel. However, a tip portion at the forward end of the cylindrical member is provided with a protrusion so that washing liquid will tend to drip off the tip of the cylinder instead of running back along the outside of the channel.

In a preferred embodiment (not shown), the scrubbing means is arranged with the end extending from the first surface portion below horizontal. This facilitates that water will be directed to the scrubbing surface even if it is lost from the channelling means.

The embodiment shown in FIG. 1 to FIG. 4 represents the best mode known to the inventor to carry out the invention. Hence, the invention may be carried out by other embodiments having only the features of an independent claim. Furthermore, an individual feature or combination of features from an embodiment of the invention described herein, as well as obvious variations thereof, are combinable with or exchangeable for features of the other embodiments described herein, unless the person skilled in the art would immediately realise that the resulting embodiment is not physically feasible.

TABLE OF IDENTIFICATION

2 Body
4 Compartment
6 Scrubbing means
8 First surface portion
10 Scrubbing surface
12 First aperture
14 Second aperture
16 Third aperture
18 Channelling means
20 Bottom wall portion
22 Lower side wall portion
24 End wall portion
26 Tight layer of brush bristles
28 Elastic member
30 Sub-compartment
32 Lower side sub-wall portion
34 End sub-wall portion
36 Further compartment
40 First blind tube
42 Second blind tube
52 Plate of elastic material
60 Base part
62 Top part
70 Connection to handle member

The invention claimed is:

1. A brush for use in washing an object, particularly for washing non-horizontal surfaces, said brush comprising a body with a plurality of scrubbing members attached to a first surface portion of said brush, the scrubbing members forming a scrubbing surface away from the first surface portion, the body further comprising:

a compartment for containing a washing liquid;

a first aperture arranged for fluid communication between the first surface portion of said brush and the compartment for allowing washing liquid to flow out of said compartment;

a second aperture arranged for fluid communication between a surface of said body and the compartment for introducing washing liquid into the compartment;

a channelling element extending from near the first aperture at the first surface portion of the brush towards the scrubbing surface; and a third aperture arranged for allowing air to exit said compartment when washing liquid flows into said compartment through said first aperture, wherein the third aperture is open to a second surface portion of said brush away from the first surface portion of said brush, and wherein the third aperture includes a water seal structure comprising a first tube connected to the body at the first surface portion and a second tube connected to the body away from the first surface portion, wherein the first and the second tubes being arranged so that the second tube fits into or around the first tube and a zigzag opening is formed between the compartment and the second surface portion via the first and the second tubes, and wherein the tubes are arranged substantially parallel to a lower side wall portion.

2. A brush according to claim 1, wherein the body further comprises a washing liquid retaining structure.

3. A brush according to claim 1, wherein walls forming the compartment comprise a bottom wall portion substantially parallel to the first surface portion, a lower side wall portion forming a generally horizontal floor of the compartment when the brush is arranged for washing of vertical surfaces, and end wall portions for preventing washing liquid from exiting the compartment via the ends of the compartment.

4. A brush according to claim 1, wherein the channelling element includes a channel-like structure arranged at least below the first aperture when the brush is arranged for washing of vertical surfaces.

5. A brush according to claim 1, wherein the channelling element includes a channel-like structure that encircles at least 180° of the first aperture.

6. A brush according to claim 1, wherein the channelling element comprises some of the plurality of scrubbing members arranged in a layer near the first aperture.

7. A brush a according to claim 1, wherein the channelling element comprises an elastic member that is not water permeable.

8. A brush according to claim 1, wherein the first aperture is in a bottom wall portion near a lower side wall portion.

9. A brush according to claim 8, further comprising a further aperture in fluid communication between the first surface portion of the brush and the compartment, wherein the compartment extends along a substantial horizontal length of the brush when the brush is arranged for washing of vertical surfaces, wherein the further aperture and the first aperture are arranged away from each other near the end wall portions of the compartment.

10. A brush according to claim 1, wherein the body further comprises:

a second compartment;

another first aperture arranged for fluid communication between the first surface portion of said brush and the second compartment for allowing washing liquid to flow out of said second compartment; and another second aperture arranged for fluid communication between a surface of said body and the second compartment for introducing washing liquid into the second compartment.

11. A brush according to claim 1, wherein the first aperture is arranged away from a lower edge of the first surface portion of the brush when the brush is arranged for washing of vertical surfaces, wherein the distance between the first aperture and the lower edge is sufficient to allow for arrangement of the channelling element at least partially below the first aperture when the brush is arranged for washing of vertical surfaces.

12. A brush according to claim 1, wherein the compartment is arranged higher than a lower edge of the first surface portion of the brush when the brush is arranged for washing of vertical surfaces.

13. A brush according claim 1, wherein the third aperture has an opening that is adjustable in size.

14. A brush according to claim 1, wherein said body further comprises a throttling valve arranged at said second aperture and operable for throttling the return flow of washing liquid from said compartment though said second aperture.

15. A brush according claim 14, wherein said throttling valve comprises a plate of elastic material having a size larger than said second aperture and having a portion thereof arranged at least partially on the inner wall surface of said compartment adjacent said second aperture such that said plate in relaxed condition substantially covers said second aperture, wherein said plate is biased towards the second aperture.

16. A brush according to claim 1, further comprising a dispensing mechanism operative to dispense an additive material into the compartment though an additive conduit opening at the first surface of said body.

17. A brush according to claim 16, further comprising a second channelling element arranged near the additive conduit opening.

18. A brush according to claim 1, wherein the body comprises a base part and a top part forming an air tight connection to the base part.

* * * * *